US009379468B2

(12) United States Patent
Zieman et al.

(10) Patent No.: US 9,379,468 B2
(45) Date of Patent: Jun. 28, 2016

(54) APPARATUS AND METHOD FOR ALLOWING ALIGNMENT MISMATCH IN ELECTRICAL CONNECTIONS

(71) Applicant: CISCO TECHNOLOGY, INC., San Jose, CA (US)

(72) Inventors: Christopher E. Zieman, Chapel Hill, NC (US); Kevin F. Casey, Cary, NC (US)

(73) Assignee: Cisco Technology, Inc., San Jose, CA (US)

( * ) Notice: Subject to any disclaimer, the term of this patent is extended or adjusted under 35 U.S.C. 154(b) by 241 days.

(21) Appl. No.: 13/661,168

(22) Filed: Oct. 26, 2012

(65) Prior Publication Data

US 2014/0120760 A1 May 1, 2014

(51) Int. Cl.

| | |
|---|---|
| ***H01R 12/91*** | (2011.01) |
| *H01R 13/187* | (2006.01) |
| *H01R 13/11* | (2006.01) |
| *H01R 25/16* | (2006.01) |
| *H01R 101/00* | (2006.01) |

(52) U.S. Cl.

CPC ..... *H01R 12/91* (2013.01); *H01R 13/111* (2013.01); *H01R 13/187* (2013.01); *H01R 25/162* (2013.01); *H01R 2101/00* (2013.01); *Y10T 29/49204* (2015.01)

(58) Field of Classification Search

CPC .. H01R 12/91; H01R 13/111; H01R 2101/00; H01R 25/162; H01R 13/187; H01R 9/091; H01R 13/6315; H01R 12/585; H01R 12/712

USPC ..... 439/335, 338, 341, 350, 370, 380, 447, 439/775, 780, 816, 852, 75, 246, 247, 248, 439/843, 851, 80, 176, 748

See application file for complete search history.

(56) References Cited

U.S. PATENT DOCUMENTS

| | | | | |
|---|---|---|---|---|
| 3,107,968 | A | 10/1963 | Bonhomme | |
| 4,203,647 | A | 5/1980 | Bonhomme | |
| 4,447,108 | A | 5/1984 | Ghigliotti et al. | |
| 4,840,587 | A | 6/1989 | Lancella | |
| 5,055,055 | A * | 10/1991 | Bakker | 439/78 |
| 5,807,120 | A * | 9/1998 | Matthews | 439/80 |
| 6,319,021 | B1 * | 11/2001 | Billman | 439/78 |
| 6,431,891 | B1 * | 8/2002 | Billman | 439/176 |
| 6,471,555 | B2 | 10/2002 | Creze | |
| 7,805,838 | B2 | 10/2010 | Morana et al. | |
| 8,029,326 | B2 * | 10/2011 | Rossman | 439/843 |
| 8,784,143 | B2 * | 7/2014 | Edgell et al. | 439/843 |
| 2006/0194465 | A1 * | 8/2006 | Czikora | 439/248 |
| 2009/0149086 | A1 * | 6/2009 | Dahms | 439/835 |
| 2009/0186534 | A1 | 7/2009 | Taylor | |
| 2009/0197482 | A1 * | 8/2009 | Mark et al. | 439/852 |
| 2012/0109202 | A1 * | 5/2012 | Kretzer et al. | 606/248 |

* cited by examiner

*Primary Examiner* — Amy Cohen Johnson
*Assistant Examiner* — Matthew T Dzierzynski
(74) *Attorney, Agent, or Firm* — Merchant & Gould P.C.

(57) ABSTRACT

An apparatus includes a first electrical connector including a first housing, a contact element having a first portion connected to the first housing, and a first elastic element for supporting the first portion in the first housing. The first elastic element is deflectable to permit the contact element to move relative to the first housing. The apparatus also includes a second electrical connector including a second housing and a second elastic element that is deflectable to receive and retain a second portion of the contact element that protrudes from the first housing.

26 Claims, 7 Drawing Sheets

APPARATUS AND METHOD FOR ALLOWING ALIGNMENT MISMATCH IN ELECTRICAL CONNECTIONS

TECHNICAL FIELD

This disclosure relates generally to an apparatus and method for establishing an electrical connection of components where there may be an alignment mismatch between the components.

BACKGROUND

In various electrical/electronic hardware structures, it is necessary to establish electrical connections between various components of the structure. In such systems, it may be desirable to establish direct electrical connections between the components (i.e., without wires or cables) when the components are mounted, for example, to a chassis. In this instance, the components can be designed to physically align and interconnect mating electrical connectors when the components are mounted to the chassis. Physical tolerances can require that the components and the structure itself be constructed with a certain degree of precision. Nevertheless, the number, size, and distance between the components in the hardware structure can cause these low tolerances to add or "stack" such that there is a mismatch or misalignment between the electrical connections. Additionally, the need to establish or make the connection simultaneously with the installation of the component can further necessitate the need for precision.

As a further example, a computer server chassis may have a power input module that includes a high power electrical connection to a chassis mounted bus bar. Since both the power input module and the bus bar are rigidly mounted to the chassis, the relative positions of the mating electrical connectors can also be rigid. If these connectors are misaligned, the misalignment is also rigid. Additionally, in the case of a high power electrical connection, the capability to withstand current draws necessitates the use of heavy gauge connectors, which add to the rigidity of the misalignment. Designing the structure to withstand environmental conditions, such as vibrations, can further add to the rigidity of the misalignment. In this scenario of misaligned rigid electrical connectors, it can be extremely difficult to make a direct electrical connection.

DESCRIPTION OF EXAMPLE EMBODIMENTS

Overview

This disclosure relates to an apparatus and method for establishing an electrical connection between components where there may be a misalignment or an alignment mismatch between the components. In this description, the terms "misalignment" and "alignment mismatch" are used interchangeably. In one example, an apparatus can include a first "male" electrical connector connectable with a first component and a second "female" electrical connector connectable with a second component. The first connector includes a contact element, such as a pin, and an elastic element for supporting a first portion of the contact element in a housing. The elastic element is deflectable to permit the contact element to move relative to the housing. The second connector includes a socket in the form a housing and an elastic element. The elastic element is deflectable to receive and retain a protruding second portion of the contact element of the first connector. The elastic elements, being deflectable, allow the second connector to receive and retain the contact element even though there may be some misalignment between the first and second components.

Example Embodiments

Figure 1A:
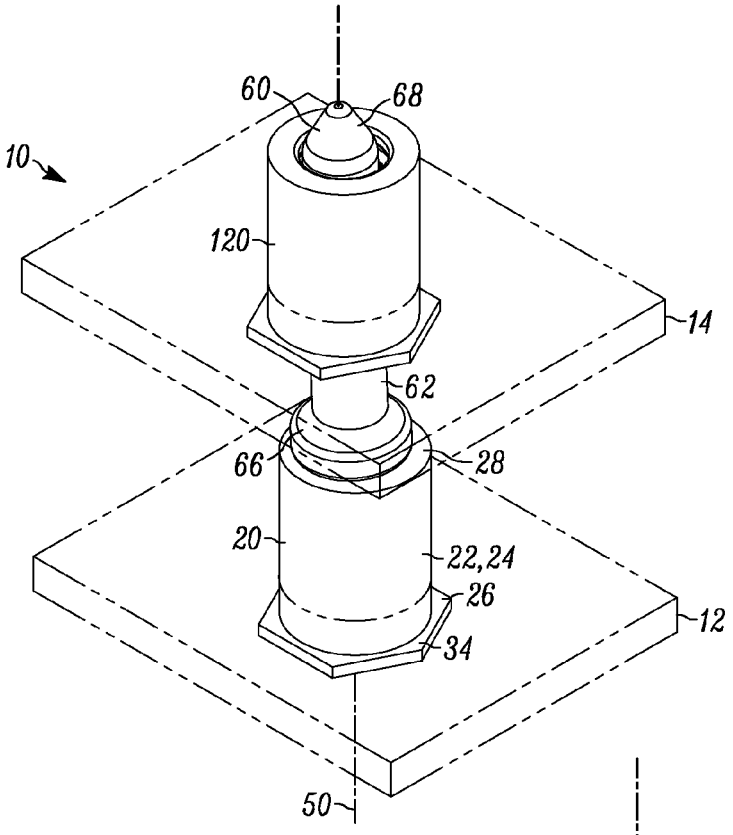
FIGS. 1A and 1B depict an example of an electrical connector apparatus.
Figure 1B:
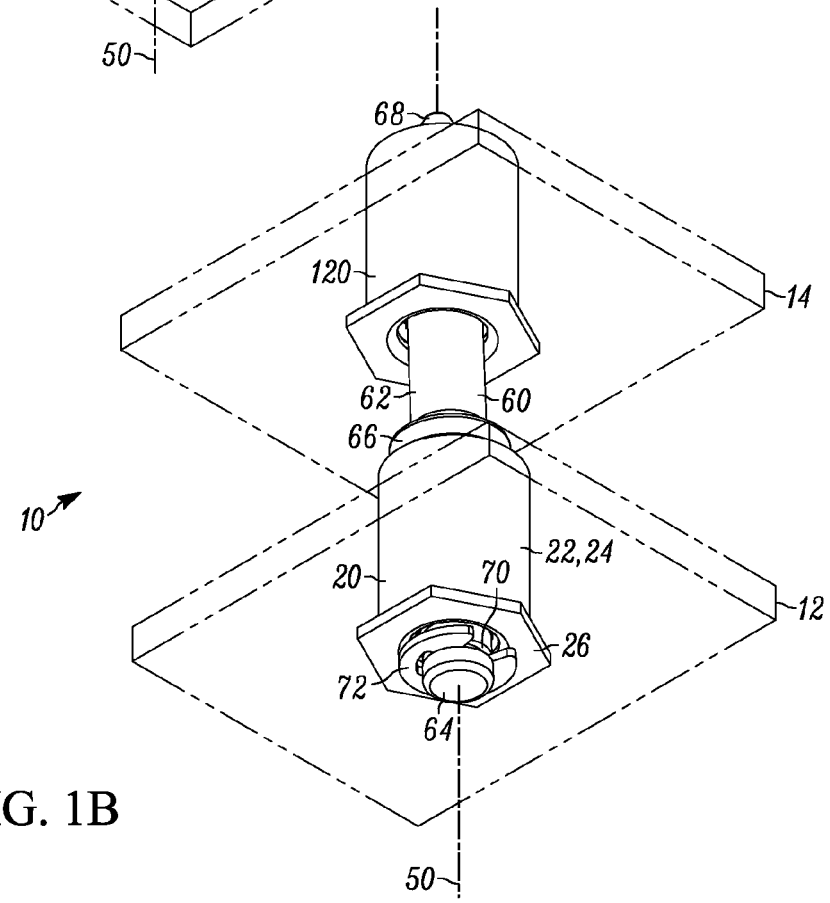

FIGS. 1A and 1B depict an example of an apparatus 10 for providing an electrical connection. The apparatus 10 can be implemented to provide an electrical connection between components 12, 14 of an electrical device or system. The electrical connection can, for example, be a high power electrical connection, such as one used to deliver electricity to/from a power supply. In one example, the components 12, 14 can be bus bar and/or a printed circuit board for distributing electricity in a network server chassis or cabinet. In this example, the apparatus 10 can provide a high power electrical connection between bus bar 12 and bus bar 14. Alternatively or additionally, in this example, the apparatus 10 can provide a high power electrical connection between bus bar 12 and printed circuit board 14, or vice versa. As an example, the apparatus 10 can be implemented in a network server cabinet to deliver power from a chassis mounted bus bar to a printed circuit board mounted bus bar, e.g., on a power supply for distributing power to various modules in the server cabinet.

The apparatus 10 includes a first electrical connector 20 and a second electrical connector 120 that mates with the first connector to establish an electrical connection. In the example illustrated in FIGS. 1A and 1B, the first connector 20 is associated with component 12 and the second connector 120 is associated with component 14. Thus, in this implementation, the first and second connectors 20 and 120 engage and mate with each other to establish an electrical connection between the components 12, 14. These associations could be reversed, with the first connector 20 associated with the second component 14 and the second connector 120 associated with the first component 12.

The first connector 20 can be considered what is commonly referred to in the art as a "male" connector that mates with the second connector 120, which can thus be considered what is commonly referred to in the art as a "female" connector. Additionally or alternatively, the first connector 20 can be considered what is commonly referred to in the art as a "pin" connector that mates with the second connector 120, which can be considered what is commonly referred to in the art as a "socket" connector. Although the first/second connector designations are maintained in this description, the alternative designations male/female and pin/socket could also be used interchangeably.

Figure 2:
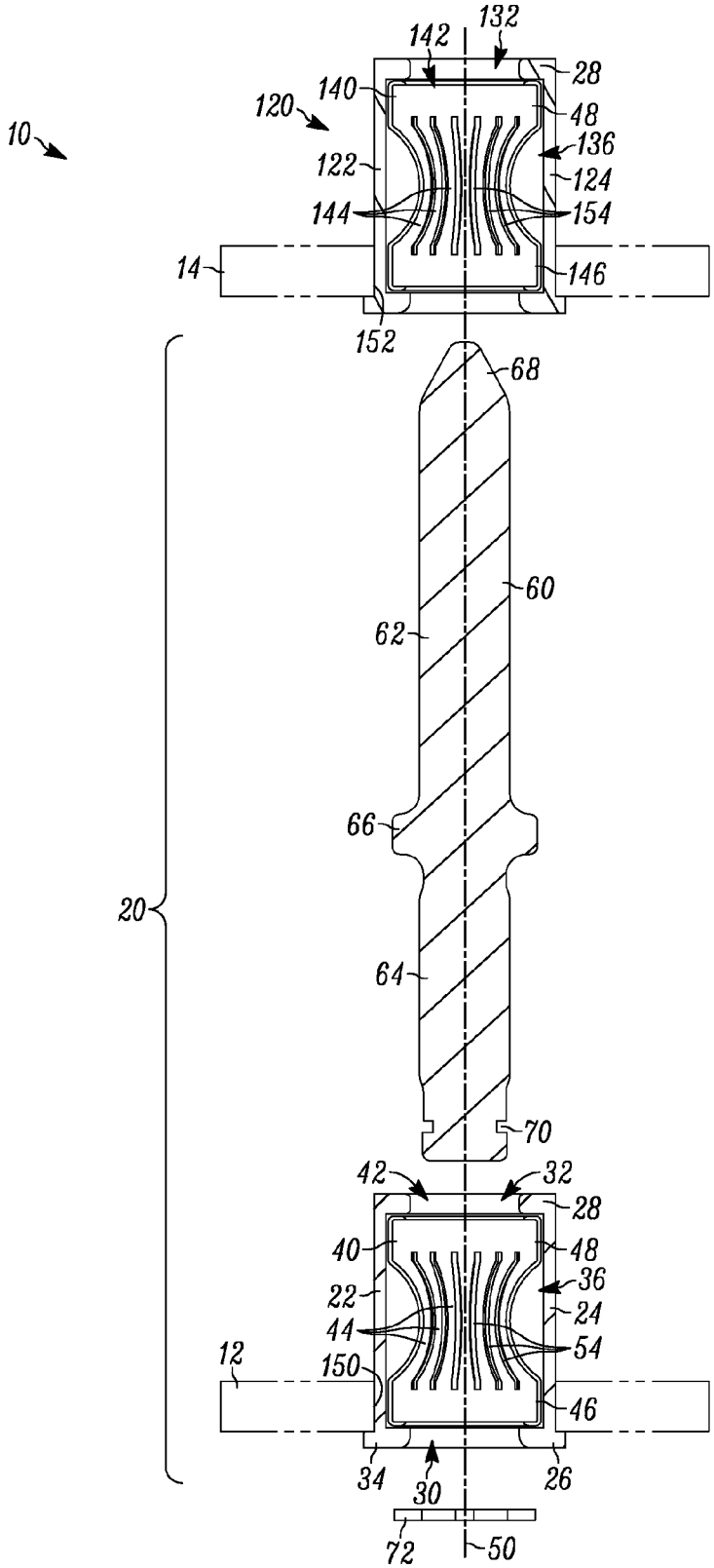
FIG. 2 depicts an exploded sectional view of the apparatus of FIGS. 1A and 1B.

Referring to FIGS. 1A, 1B, and 2, the first connector 20 includes a housing 22, an elastic element 40 supported in the housing, and a contact pin or element 60 that is at least partially supported in the housing by the elastic element. The housing 22 can be formed from an electrically conductive material so as to form an electrically conductive contact or circuit with the first component 12. The housing 22 has a cylindrical side wall 24, a first end wall 26, and an opposite second end wall 28. The first end wall 26 extends radially inward from the side wall 24 and has a central opening or aperture 30. The first end wall 26 also extends radially outward beyond the side wall 24, thus forming an annular shoulder 34. As shown in FIGS. 1A and 1B, the first end wall 26 may have a generally hexagonal configuration, although alternative configurations, such as round, can also be used. The second end wall 28 extends radially inward from the side wall 24 and has a central opening or aperture 32. The side wall 24, end walls 26, 28, and apertures 30, 32 are centered on a longitudinal axis 50 of the apparatus 10 that is common to both the first and second connectors 20 and 120. The side wall 24 and end walls 26, 28 help define a cylindrical inner space 36 of the housing 22 in which the elastic element 40 is supported.

The elastic element 40 is supported in the inner space 34 of the housing 22 between the end walls 26, 28. For example, the elastic element 40 can be supported in the housing 22 by placing the element in the inner space 36 prior to forming one or both of the end walls 26, 28 and then subsequently forging or swaging the end walls using a die. Alternative constructions, such as forming the housing 22 in two connectable pieces, could also be used to allow for assembling the housing 22 with the elastic element 40 supported in the inner space 36 to thereby construct the first connector 20.

The elastic element 40 is an electrically conductive element that is centered on the axis 50 and defines a central space 42 for receiving the contact element 60. The elastic element 40 is a generally compliant structure, deflecting radially outward when receiving the contact element 60 and correspondingly applying a radially inward compressive force onto the contact element due to the configuration and the elastic properties of the material used to construct the elastic element. Therefore, it will be appreciated that the elastic element 40 can have a variety of constructions that serve to achieve this function.

In the example embodiment of FIGS. 1A-3C, the elastic element 40 has a hyperboloid structure in which a plurality of beams 44 extend between cylindrical ends 46, and 48 of the element. The beams 44 are bent or curve inward toward the axis 50, taking a hyperbolic form and thereby act in the manner of leaf springs. The beams 44 are thus deflectable radially outward, away from the axis 50, and correspondingly apply a radially compressive spring force inwardly toward the axis when so deflected.

The contact element 60 forms the pin of the pin/socket configuration of the apparatus 10. The contact element 60 has a generally elongated configuration with a head portion 62 and a tail portion 64 separated by a stop portion 66, each of which has a generally cylindrical configuration. The head portion 62, tail portion 64, and stop portion 66 can be aligned with each other and centered along the axis 50. The head portion 62 can have a tapered, conical or frusto-conical tip 68. The stop portion 66 can have a diameter that is greater than the diameters of both the head portion 62 and tail portion 64 and has an axial length that is shorter than the lengths of the head and tail portions. The stop portion 66 thus forms an annular shoulder that extends radially outward at the interface between the head portion 62 and tail portion 64. In the example illustrated in FIGS. 1A-3C, the stop portion 66 is located in the vicinity of the middle of the length of the contact element 60. The stop portion 66 could, however, be positioned at alternative locations along the length of the contact element 60.

The tail portion 64 has a terminal end portion that includes an annular groove 70 for receiving a fastening element, in the form of a retaining ring 72, which helps secure the contact element 60 to the housing 22. Alternative fastening means or methods could be used to provide this connection. For example, the terminal end portion of the tail portion 64 could have a reduced diameter with external threads for receiving a threaded fastener, such as a nut. As another example, the terminal end portion of the tail portion 64 could have an internally threaded axial bore for receiving a threaded fastener, such as a bolt or screw. As further example, the terminal end portion of the tail portion 64 could be swaged to form an interference with the end wall 26 of the housing 22.

To assemble the first electrical connector 20, the tail portion 64 of the contact element 60 is inserted into the central space 42 of the elastic element 40 positioned in the inner space 36 of the housing 22. The tail portion 64 is passed through the central space 42 such that the annular groove 70 protrudes from the aperture 30 in the first end wall 26 of the housing 22. The retaining ring 72 is installed in the groove 70 thereby connecting the contact element 60 to the housing 22. An interference between the retaining ring 72 and the aperture 30 in the first end wall 26 of the housing, and an interference between the stop portion 66 and the aperture 32 in the second end wall 28 of the housing prevent the contact element 60 from being removed from the housing 22.

When the first electrical connector 20 is assembled, there is a clearance between the contact element 60 and the apertures 30, 32 in the first and second end walls 26, 28, respectively. These clearances permit the contact element 60 to move or "float" relative to the housing 22. The first connector 20 can thus be considered to have a "floating pin" configuration. In this floating pin configuration, the contact element 60 can move laterally relative to the axis 50, i.e., the contact element can remain parallel to the axis and move in a lateral direction so that the contact element is no longer coaxial with the axis 50. The contact element 60 also can move transverse relative to the axis 50, i.e., the contact element can pivot or twist such that the contact element is neither coaxial or parallel to the axis 50. Additionally, there can be a clearance between the stop portion 66 and the second end wall 28 and the retaining ring 72 and the first end wall 26 that permits the contact element 60 to move axially relative to the housing 22, i.e., along the axis 50 regardless of any lateral or transverse relation between the contact element 60 and the housing 22.

From this, it can be appreciated that the first connector 20 employs a floating pin configuration in which the contact element 60 serves as a pin that can move freely in three dimensions within the housing 22. The amount of such floating movement of the contact element 60 can be limited by the physical constraints placed on it by the housing 22, by the elastic element 40, and by the configuration of the contact element itself.

Referring to FIGS. 1A, 1B, and 2, the second connector 120 includes a housing 122 and an elastic element 140 supported in the housing. The housing 122 and elastic element 140 can be similar or identical to the housing 22 and elastic element 40 of the first connector 20. The housing 122 can be formed from an electrically conductive material so as to form an electrically conductive contact or circuit with the second component 14. The housing 122 has a cylindrical side wall 124, a first end wall 126, and an opposite second end wall 128. The first end wall 126 extends radially inward from the side wall 124 and has a central opening or aperture 130. The first end wall 126 also extends radially outward beyond the side wall 124, thus forming an annular shoulder 134. As shown in FIGS. 1A and 1B, the first end wall 126 may have a generally hexagonal configuration, although alternative configurations, such as round, can also be used. The second end wall 128 extends radially inward from the side wall 124 and has a central opening or aperture 132. The side wall 124, end walls 126, 128, and apertures 130, 132 are centered on the longitudinal axis 50. The side wall 124 and end walls 126, 128 help define a cylindrical inner space 136 of the housing 122 in which the elastic element 140 is supported.

The elastic element 140 is supported in the inner space 136 of the housing 122 between the end walls 126, 128 in a manner that can be similar or identical to that of the corresponding components of the first connector 20. For example, the elastic element 140 can be supported in the housing 122 by placing the element in the inner space 136 prior to forming one or both of the end walls 126, 128 and then subsequently forging or swaging the end walls using a die. Alternative constructions, such as forming the housing 122 in two connectable pieces, could also be used to allow for supporting the elastic element 140 in the inner space 136.

The elastic element 140 can be similar or identical to the elastic element 40 of the first connector 20. The elastic element 140 is an electrically conductive element that is centered on the axis 50 and defines a central space 142 for receiving the contact element 160. The elastic element 140 is a generally compliant element, deflecting radially outward when receiving the contact element 160 and correspondingly applying a radially inward compressive force onto the contact element due to the configuration and the elastic properties of the material used to construct the elastic element. Therefore, it will be understood that the elastic element 140 can be implemented to have a variety of constructions that serve to achieve this function.

In the example of FIGS. 1A-3C, the elastic element 140 can have a hyperboloid structure that is similar or identical to the structure of the elastic element 40 of the first connector 20. The elastic element 140 thus can include a plurality of beams 144 extend between cylindrical ends 146, and 148 of the element. The beams 144 are bent or curve inward toward the axis 50, taking a hyperbolic form and thereby acting in the manner of leaf springs. The beams 144 are thus deflectable radially outward, away from the axis 50, and correspondingly apply a radially compressive spring force inward toward the axis when so deflected.

The hyperboloid configuration of the elastic elements 40, 140 of FIGS. 1A-3C can be formed in a variety of manners. For example, the elastic elements 40, 140 can be formed from a sheet of material, such as steel (e.g., spring steel) that is stamped or otherwise machined to form slots 54, 154 that define the beams 44, 144, respectively. The sheet can then be rolled or otherwise placed in a cylindrical form that is maintained by way of a connection, such as a weld. The hyperbolic form of the beams 44, 144 can then be formed in a variety of manners, such as by twisting the cylindrical ends 46, 146, 46, 148 in opposite directions about the axis 50, causing the beams to deflect inward and take on the hyperbolic form. Alternatively or in combination, the hyperbolic form of the generally axially extending beams 44, 144 can be formed mechanically, using a die tool. As an additional alternative example, the elastic elements 40, 140 can be constructed using one or more lengths of a metal wire material, such as spring steel. In this construction, the wire material can be twisted, bent, wrapped, or otherwise formed into the desired curved (e.g., hyperbolic) configuration.

The compressive force applied by the elastic elements 40, 140 is owed to a variety of factors, such as the configuration of the elements and the materials selected to construct the elements. For example, materials such as spring steel have known spring/elastic properties and can therefore be selected to provide a desired degree of compressive force. As another example, the hyperbolic shape or form of the beams 44, 144 can be configured to apply the radially compressive force with the desired magnitude.

By way of further example, for a given material, the radially compressive force applied by the elastic elements 40, 140 can be related to the amount of deflection the beams 44, 144 undergo while receiving the contact element 60. Therefore, by reducing the size or diameter of the central space 42, 142, the interference between the contact element 60 and the elastic element 40, 140 can be increased, thus producing a corresponding increase in beam deflection and compressive force. Additionally or alternatively, the overall length of the elastic elements 40, 140 and, thus, the beams 44, 144 can be increased/decreased in order to help provide the desired compressive properties. Other factors being equal, an increase in the length of the beams 44, 144 produces a corresponding decrease in spring stiffness and the compressive force of the elastic element 40, 140. Conversely, a decrease in the length of the beams 44, 144 produces a corresponding increase in spring stiffness and the compressive force of the elastic element 40, 140.

The first and second electrical connectors 20, 120 can be connected to the components 12, 14 in a variety of manners. For the example embodiment of FIGS. 1A-3C, the first and second connectors 20, 120 can be press-fitted into the components 12, 14. In this example, the outside diameter of the housings 22, 122 is configured to create an interference with inside diameters of respective openings 150, 152 (see FIG. 2). This would allow the housings 22, 122 to make electrical contact with electrically conductive portions of the components 12, 14, such as metal side walls of the openings 150,152 in the case of a bus bar, or plated side walls of the openings in the case of a printed circuit board. Alternatively, the first and second connectors 20, 120 could be connected to the components 12, 14 via a mechanical connection, such as by threading a portion of the outside diameter of the housings 22, 122 and using a threaded fastener, such as a nut, to make the connection.

Figure 3C:
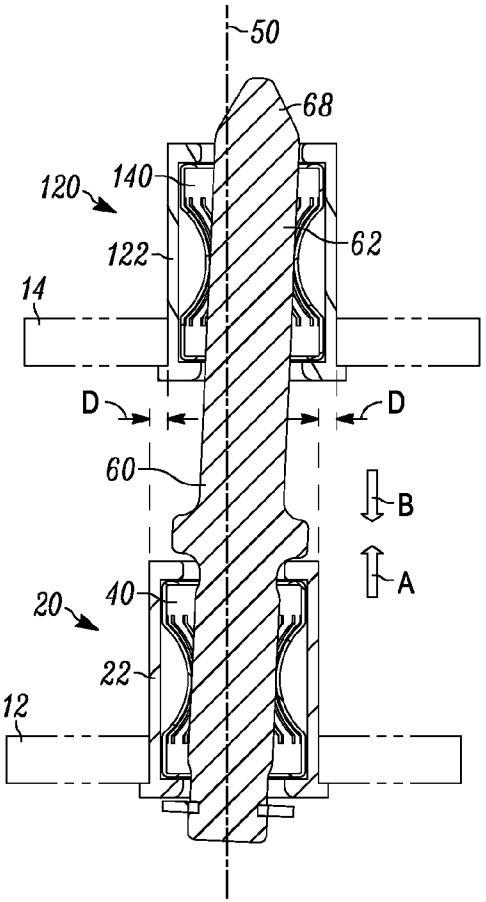
FIGS. 3A-3C depict the function of the apparatus of FIGS. 1A-2.
Figure 3B:
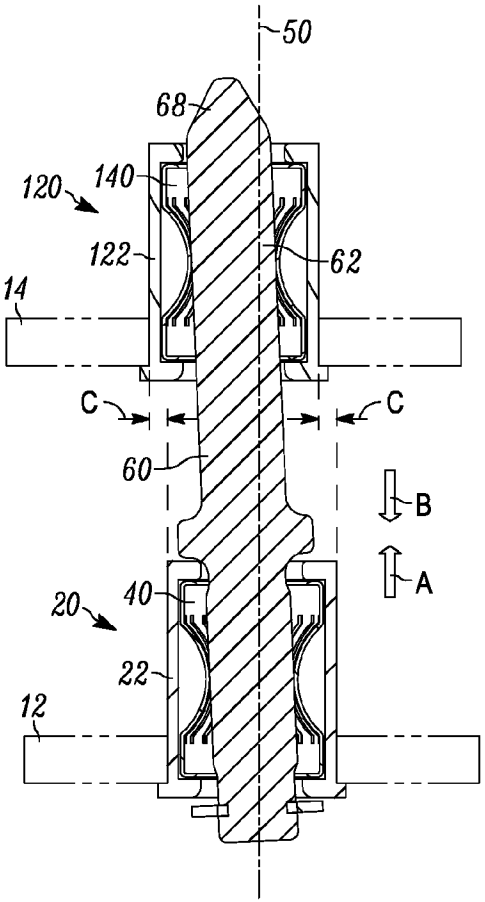
Figure 3A:
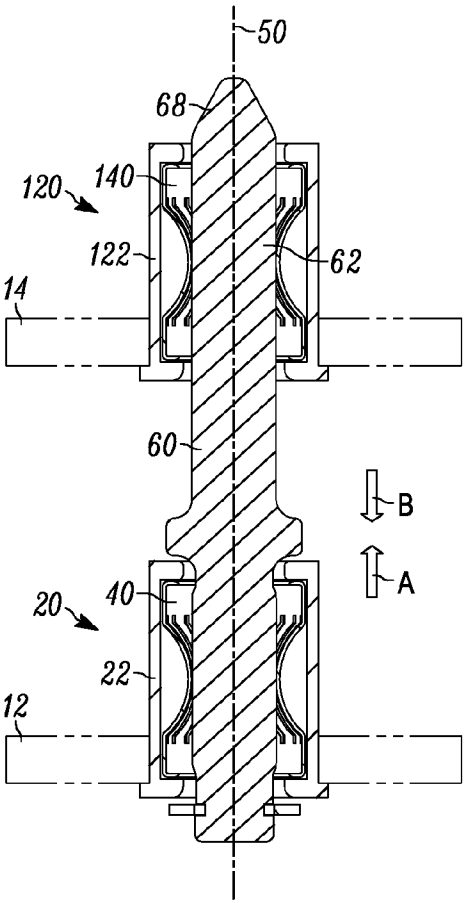

The apparatus 10 can establish an electrical connection between the components 12, 14 even where there may be a misalignment or an alignment mismatch between the components. This is shown in FIGS. 3A-3C. In FIG. 3A, the components 12, 14 are in alignment and, therefore, the first and second connectors 20, 120 are aligned along the axis 50. To establish the connection, the components 12, 14 are brought together such that the first and second connectors 20, 120 engage each other axially. This is indicated generally by the arrows labeled "A" and "B" in FIGS. 3A-3C. To establish the connection, the component 12 can move into engagement with stationary component 14 (arrow A); the component 14 can be brought into engagement with stationary component 12 (arrow B); or the components 12, 14 can be brought into engagement with each other simultaneously (arrows A and B). The connections can be made by various approaches, such as including being press-fit together. As another example, one or both housings could be screwed in or swaged on to provide this connection. In other examples, a threaded fastener, such as a nut can be attached to the housing and rotated to provide the connection. In yet other examples, the housings could have a square base configured to press fit pins to the bus bar or a PCB to make the connections. Other means of attachment can be utilized to provide for the physical attachment between the housings (e.g., screws, soldered, brazed).

When the components 12, 14 are brought together, the head portion 62 enters the second connector 120 and engages the elastic element 140. The beams 144 of the elastic element 140 deflect when receiving the head portion 62 and, due to their inherent resilience, apply a radially compressive force on the head portion. In this manner, the second connector 120 acts as a "compliant socket" connector in which the elastic element complies to the shape and/or orientation of the contact element 60. The compressive forces applied to the contact element 60 by the elastic elements 40, 140 establish and maintain electrical continuity between the components 12, 14. More specifically, the conductive path extends from the first component 12, through the housing 22, elastic element 40, and contact element 60, and through the elastic element 140 and housing 122 to the second component 14.

Referring to FIG. 3A, the components 12, 14 are aligned with each other, so the engaging movement between the components 12, 14 occurs essentially along the axis 50. In FIGS. 3B and 3C, there is a misalignment between the components 12, 14 that is indicated generally by the arrows labeled "C" and "D," respectively. When these mismatches occur, the conical tip 68 of the contact element 60 can act as a guide that causes the contact element to shift relative to the axis 50 as shown. The elastic element 40 permits this shifting while maintaining a strong and reliable electrical connection with the contact element 60. The tip 68 guides the head portion 62 of the contact element 60 into the second connector 120. Due to the compliant socket configuration of the second connector 120, the elastic element 140 receives and complies with the shape and orientation of the head portion 62. The elastic element 140 and applies a radially compressive force onto the head portion 62 and thereby establishes the electrical connection between the components 12, 14 despite the alignment mismatch between the components.

The apparatus 10 employs a floating pin/compliant socket design of the first and second connectors 20, 120 that can reliably establish an electrical connection between the components 12, 14 even where there is an alignment mismatch between the components. The amount of alignment mismatch that the apparatus 10 can accommodate can be controlled through the configuration of the first and second connectors 20, 120. For example, increasing/decreasing the length of the contact element 60 would produce a corresponding increase/decrease in the radial range of the tip 68 of the head portion 62, which would increase/decrease the amount of mismatch that the apparatus 10 can accommodate. As another example, the length of the elastic elements 40, 140, and the hyperbolic shape of the beams 44, 144 can be adjusted to control the degree to which the contact element 60 can move relative to the housing 22 and the degree of axial offset or transverse orientation of the contact element that the second connector 120 can accept.

Additionally, the ability for the connectors 20, 120 to accommodate an alignment mismatch can help facilitate multiple simultaneous electrical connections because the multiple connectors can also adapt to and correct for alignment mismatches between the multiple connectors pairs. That is, the apparatus 10 can be implemented to make multiple electrical connections by configuring each of the components 12 and 14 each with multiple connectors 20 and 120, respectively arranged in a common pattern for mating alignment. Furthermore, the floating pin design of the apparatus 10 can establish the electrical connections of the components 12, 14 simultaneously with the physical installation of the component(s) in the system.

The apparatus 10 establishes an electrical connection between the components that is effective, reliable, and capable of handling high power loads. For example, the apparatus 10 can be used to establish bus bar or circuit board power connections capable of withstanding 100 Amps or more. The floating pin design of the connectors 20, 120 allows for these reliable high power connections while allowing for misalignment between the components. In one example, the first and second connectors 20, 120 can be capable of establishing these high power connections while accommodating radial misalignments in excess of 0.040 inches or more. Configurations capable of accommodating radial alignments of greater or lesser magnitudes can also be configured.

To help facilitate this high power connection, the mating surfaces of the first and second connectors 20, 120, i.e., the mating surfaces between the contact element 60 and the respective elastic elements 40, 140, can have certain attributes that promote a strong and reliable electrical connection. For example, the mating surfaces of the first and second connectors 20, 120 can have a roughness that is eight (8) micro-inches or less. Additionally or alternatively, the mating surfaces of the first and second connectors 20, 120 can be plated with an initial layer of nickel that is at least 50 micro-inches thick and a layer of hard gold, on top of the nickel, that is at least 30 micro-inches thick.

An apparatus 200 according to a second example embodiment is illustrated in FIGS. 4A-6C. The second example embodiment of FIGS. 4A-6C is similar to the first example embodiment of FIGS. 1A-3C, with the exception that the second embodiment omits the elastic elements supported in the housings and replaces them by constructing the housings to include elastic elements as integral portions of the housings.

Figure 4A:
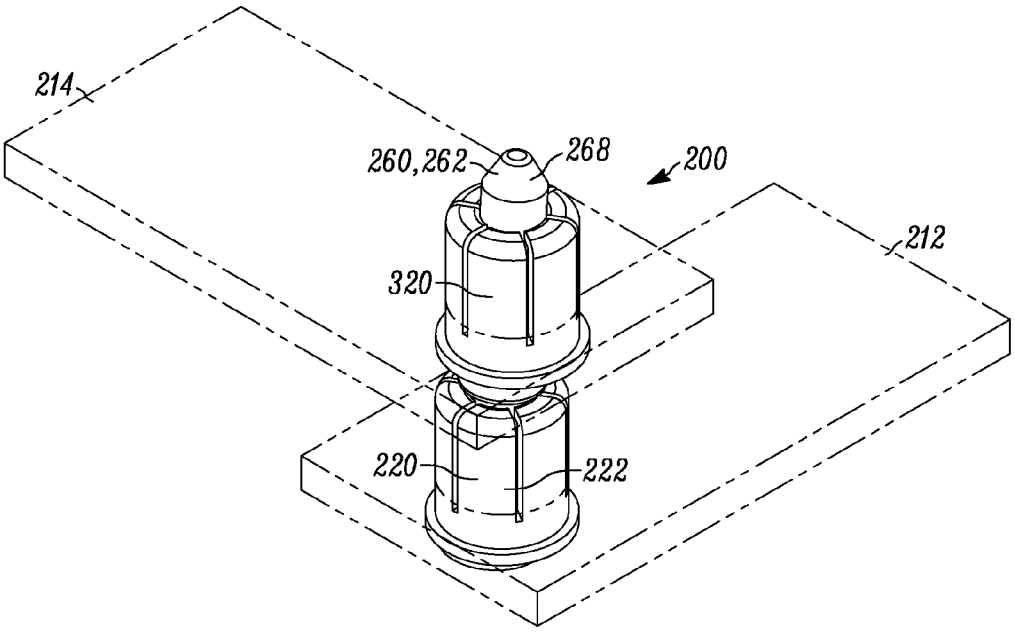
FIGS. 4A and 4B depict another example of an electrical connector apparatus.
Figure 4B:
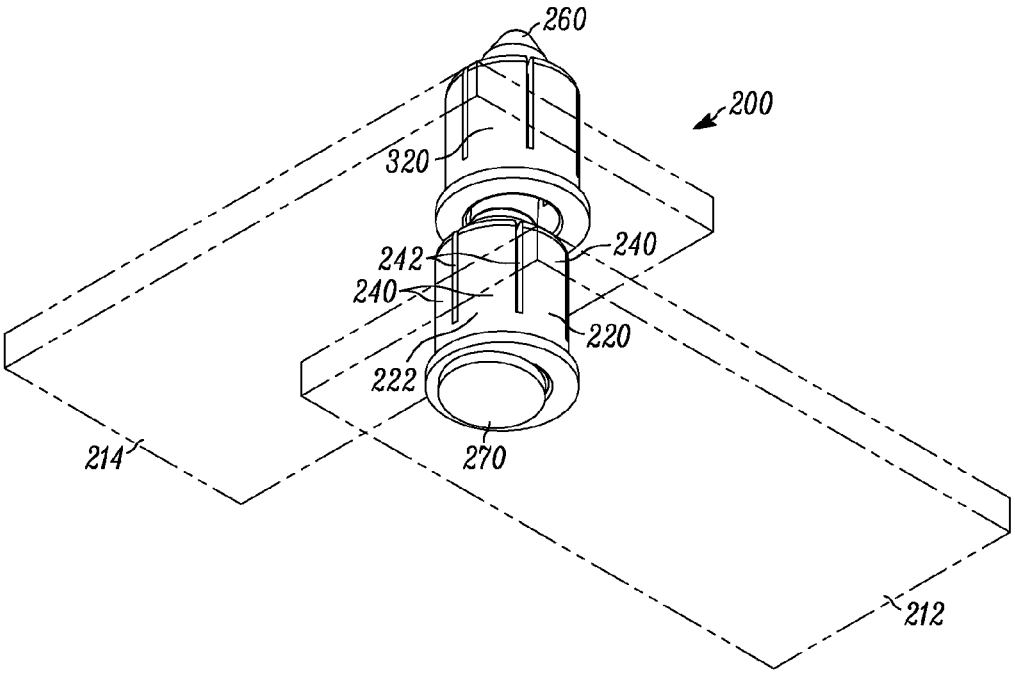

Referring to FIGS. 4A and 4B, the apparatus 200 includes a first electrical connector 220 and a second electrical connector 320 that mates with the first connector to establish an electrical connection. In the embodiment illustrated in FIGS. 4A and 4B, the first connector 220 is associated with a component 212 and the second connector 320 is associated with a component 214. Thus, in this implementation, the first and second connectors 220 and 320 engage and mate with each other to establish an electrical connection between the components 212, 214. These associations could be reversed, with the first connector 220 associated with the second component 214 and the second connector 320 associated with the first component 212.

The first connector 220 can be considered what is commonly referred to in the art as a "male" connector that mates with the second connector 320, which can thus be considered what is commonly referred to in the art as a "female" connector. Additionally or alternatively, the first connector 220 can be considered what is commonly referred to in the art as a "pin" connector that mates with the second connector 320, which can be considered what is commonly referred to in the art as a "socket" connector. Although the first/second connector designations are maintained in this description, the alternative designations male/female and pin/socket could also be used interchangeably.

Figure 5:
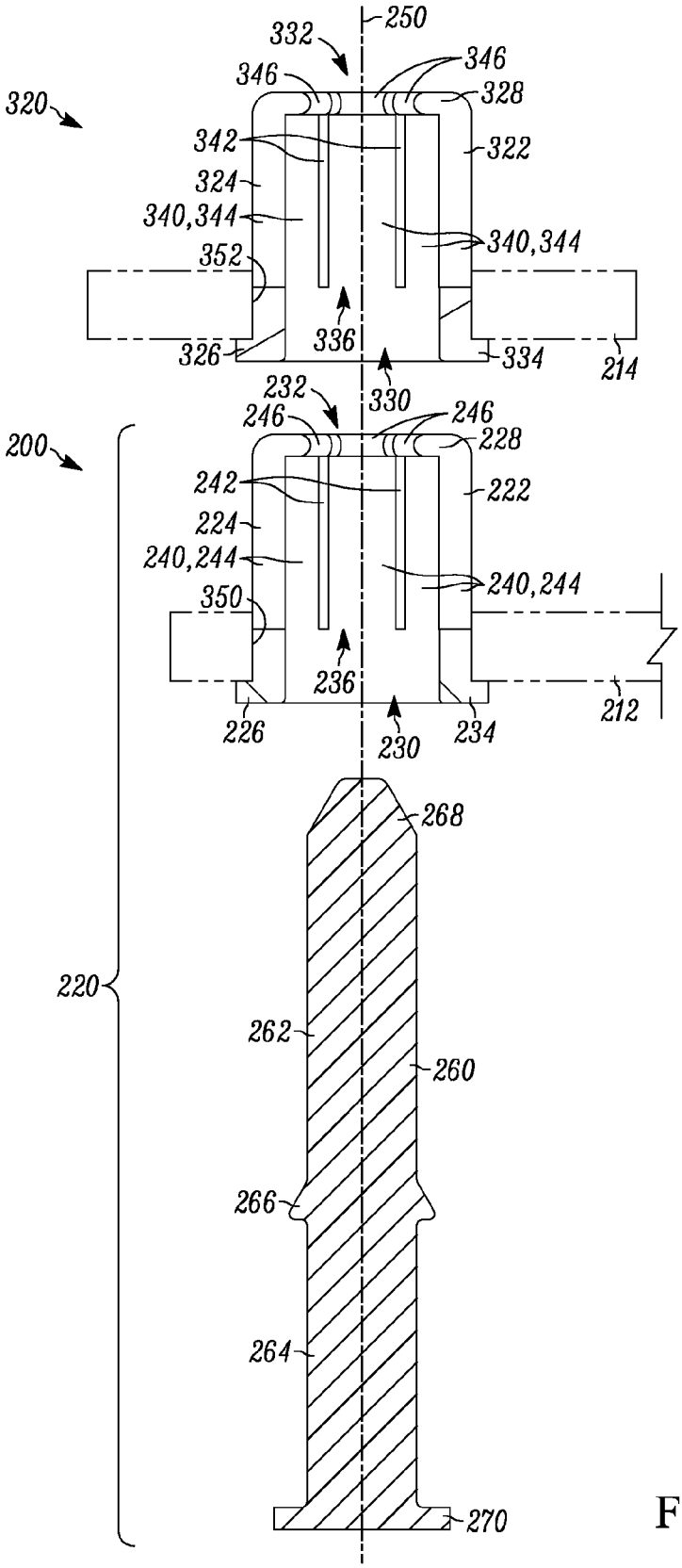
FIG. 5 depicts an exploded sectional view of the apparatus of FIGS. 4A and 4B.

Referring to FIGS. 4A, 4B, and 5, the first connector 220 includes a housing 222 and a pin or contact element 260 supported in the housing. The housing 222 can be formed from an electrically conductive material so as to form an electrically conductive contact or circuit with the first component 212. The housing 222 has a cylindrical side wall 224, a first end wall 226, and an opposite second end wall 228. The first end wall 226 extends radially outward beyond the side wall 224, thus forming an annular shoulder 234. The first end wall 226 defines a central opening or aperture 230. As shown in FIGS. 4A and 4B, the first end wall 226 may have a generally round configuration, although alternative configurations, such as polygonal, e.g., hexagonal, can also be used. The second end wall 228 extends radially inward from the side wall 224 and has a central opening or aperture 232. The side wall 224, end walls 226, 228, and apertures 230, 232 are centered on a longitudinal axis 250 of the apparatus 10 that is common to both the first and second connectors 220 and 320.

The side wall 224 and end walls 226, 228 help define a cylindrical inner space 236 of the housing 222 in which the contact element 260 is supported.

The housing 222 includes a plurality of slots 242 that extend longitudinally along the side wall 224 and through the end wall 228. The slots 242 define an elastic element 240 in the form of a plurality of spring arms that together help define the side wall 224 and end wall 228. For example, each spring arm 240 includes a beam portion 244 and a retainer portion 246. The beam portions 244 extend longitudinally, parallel to the axis 250, and combine to help define the side wall 224. The retainer portions 246 extend radially inward from the ends of the beam portions 244 and combine to help define the end wall 228, as well as the aperture 232 in the end wall.

The electrically conductive material used to construct the housing 222 may be a material, such as steel, that also exhibits elastic properties. The beams 244 are thus deflectable radially outward, away from the axis 250 and, due to their inherent resilience, correspondingly apply a radially compressive spring force inward toward the axis when so deflected.

The contact element 260 forms the pin of the pin/socket configuration of the apparatus 200. The contact element 260 has a generally elongated configuration with a head portion 262 and a tail portion 264 separated by a stop portion 266. The tail portion 264 terminates at an end stop 270. The head portion 262 and tail portion 264 each have a generally cylindrical configuration. The head portion 262, tail portion 264, stop portion 266, and end stop 270 are aligned with each other and centered along the axis 250. The head portion 262 has a tip 268, which can be tapered, conical or frusto-conical tip.

The stop portion 266 can have a frusto-conical or other tapered configuration with a base diameter that is greater than the diameters of both the head portion 262 and tail portion 264 and has an axial length that is shorter than the lengths of the head and tail portions. The stop portion 266 thus forms an annular shoulder that extends radially outward at the interface between the head portion 262 and tail portion 264. In the embodiment illustrated in FIGS. 4A-6C, the stop portion 266 is located in the vicinity of the middle of the length of the contact element 260. The stop portion 266 could, however, be positioned at alternative locations along the length of the contact element 260.

The end stop 270 has a diameter that is greater than the diameter of the tail portion 264 and has a comparatively short axial length that gives it a generally flat appearance in profile (see FIG. 5). The end stop 270 thus forms an annular shoulder that extends radially outward from the tail portion 264 at the end of the contact element 260. The end stop 270 serves as a fastening means for helping to connect the contact element 260 to the housing 222. Alternative fastening means could, however, be employed. For example, much like the embodiment of FIGS. 1A-3C, the tail portion 264 could include a terminal end portion that includes an annular groove for receiving a fastening element, such as a retaining ring. As another example, the terminal end portion of the tail portion 264 could have a reduced diameter with external threads for receiving a threaded fastener, such as a nut. As yet another example, the terminal end portion of the tail portion 264 could have an internally threaded axial bore for receiving a threaded fastener, such as a bolt or screw.

To assemble the first electrical connector 220, the head portion 262 of the contact element 260 is inserted through the opening 230 in the end wall 226 and into the inner space 236 of the housing 222. The head portion 262 passes through the opening 232 in end wall 228 as the tail portion 264 enters the housing 222. As the head portion passes through the opening 232, the angled surface of the frusto-conical tip 268 engages the retainer portions 246 due to an interference between the opening 232 and the outside diameter of the tip 268 and the head portion 262. This causes the beam portions 244 to deflect radially outward and apply a corresponding radially compressive force on the contact element 260.

As the contact element 260 is advanced through the housing 222, the stop portion 266 passes through the opening 232 in the end wall 228. Again, the angled surface of the frusto-conical stop portion 266 engages the retainer portions 246 and causes the beam portions 244 to deflect radially outward. Upon advancement of the stop portion 266 through the end wall 228, the retainer portions 246 snap over stop portion, which thereby retains the contact element 260 in the housing 222. The stop portion 266 thus prevents removal of the contact element 260 form the housing 222. The end stop 270 has an interference with the opening 230 in the end wall 228 and thus prevents the end stop from entering the inner space 236 of the housing 222.

When the first electrical connector 220 is assembled, the there is a clearance between the tail portion 264 and the opening 230 in the end wall 228. Additionally, the head portion 262 is supported by the elastic element 240, such as by the radially compressive force applied by the beam portions 244 and retainer portions 246. Since the elastic element 240 can be deflected by the contact element 260, the contact element can move or "float" relative to the housing 222. The first connector 220 can thus be considered to have a "floating pin" configuration. In this floating pin configuration, the contact element 260 can move laterally relative to the axis 250, i.e., the contact element can remain parallel to the axis and move in a lateral direction so that the contact element is no longer coaxial with the axis 250. The contact element 260 also can move transverse relative to the axis 250, i.e., the contact element can pivot or twist such that the contact element is neither coaxial or parallel to the axis 250. Additionally, there can be a clearance between the stop portion 266 and the second end wall 228, as well as between the end stop 270 and the first end wall 226, which permits the contact element 260 to move axially relative to the housing 222, i.e., along the axis 250 regardless of any lateral or transverse relation between the contact element 260 and the housing 222.

From this, it can be appreciated that the first connector 220 employs a floating pin configuration in which the contact element 260 serves as a pin that can move freely in three dimensions within the housing 222. This floating movement of the contact element 260 is, of course, limited by the physical constraints placed on it by the housing 222 and by the configuration of the contact element itself.

Referring to FIGS. 4A, 4B, and 5, the second connector 320 includes a housing 322 that can be similar or identical to the housing 222 of the first connector 220. The housing 322 can be formed from an electrically conductive material so as to form an electrically conductive contact or circuit with the second component 214. The housing 322 has a cylindrical side wall 324, a first end wall 326, and an opposite second end wall 328. The first end wall 326 extends radially outward beyond the side wall 324, thus forming an annular shoulder 334. The first end wall 326 defines a central opening or aperture 330. As shown in FIGS. 4A and 4B, the first end wall 326 may have a generally round configuration, although alternative configurations, such as polygonal, e.g., hexagonal, can also be used. The second end wall 328 extends radially inward from the side wall 324 and has a central opening or aperture 332. The side wall 324, end walls 326, 328, and apertures 330, 332 are centered on the longitudinal axis 250. The side wall 324 and end walls 326, 328 help define a cylindrical inner space 336 of the housing 322 in which the contact element 360 is supported.

The housing 322 can include a plurality of slots 342 that extend longitudinally along the side wall 324 and through the end wall 328. The slots 342 define an elastic element 340 in the form of a plurality of spring arms that together help define the side wall 324 and end wall 328. More specifically, each spring arm 340 includes a beam portion 344 and a retainer portion 346. The beam portions 344 extend longitudinally, parallel to the axis 350, and combine to help define the side wall 324. The retainer portions 346 extend radially inward from the ends of the beam portions 344 and combine to help define the end wall 328, as well as the aperture 332 in the end wall.

The electrically conductive material used to construct the housing 322 may be a material, such as steel, that also exhibits elastic properties. The beams 344 are thus deflectable radially outward, away from the axis 250 and, due to their inherent resilience, correspondingly apply a radially compressive spring force inward toward the axis when so deflected.

The compressive force applied by the elastic elements 240, 340 is owed to a variety of factors, such as the configuration of the elements and the materials selected to construct the elements. For example, materials such as spring steel have known spring/elastic properties and can therefore be selected to provide a desired degree of compressive force. As another example, the shape or form of the beam portions 344 and/or retainer portion 346 can be configured to apply the radially compressive force with the desired magnitude.

By way of further example, for a given material, the radially compressive force applied by the elastic elements 240, 340 can be related to the amount of deflection the beams 244, 344 undergo while receiving the contact element 260. Therefore, by reducing the size or diameter of the opening 332, the interference between the contact element 260 and the retainer portions 346 can be increased, thus producing a corresponding increase in beam deflection and compressive force. Additionally or alternatively, the overall length of the beams portions 244, 344 can be increased/decreased in order to help provide the desired compressive properties. Other factors being equal, an increase in the length of the beams 244, 344 produces a corresponding decrease in spring stiffness and the compressive force of the elastic elements 240, 340. Conversely, a decrease in the length of the beams 244, 344 produces a corresponding increase in spring stiffness and the compressive force of the elastic elements 240, 340.

The first and second electrical connectors 220, 320 can be connected to the components 212, 214 in a variety of manners. For instance, in the example embodiment of FIGS. 4A-6C, the first and second connectors 220, 320 are press-fitted into the components 12, 14. In this example, the outside diameter of the housings 222, 322 is configured to create an interference with inside diameters of respective openings 350, 352 (see FIG. 5). This would allow the housings 222, 322 to make electrical contact with electrically conductive portions of the components 212, 214, such as metal side walls of the openings 350, 352 in the case of a bus bar, or plated side walls of the openings in the case of a printed circuit board. Alternatively, the first and second connectors 220, 320 could be connected to the components 212, 214 via a mechanical connection, such as by threading a portion of the outside diameter of the housings 222, 322 and using a threaded fastener, such as a nut, to make the connection.

Figure 6C:
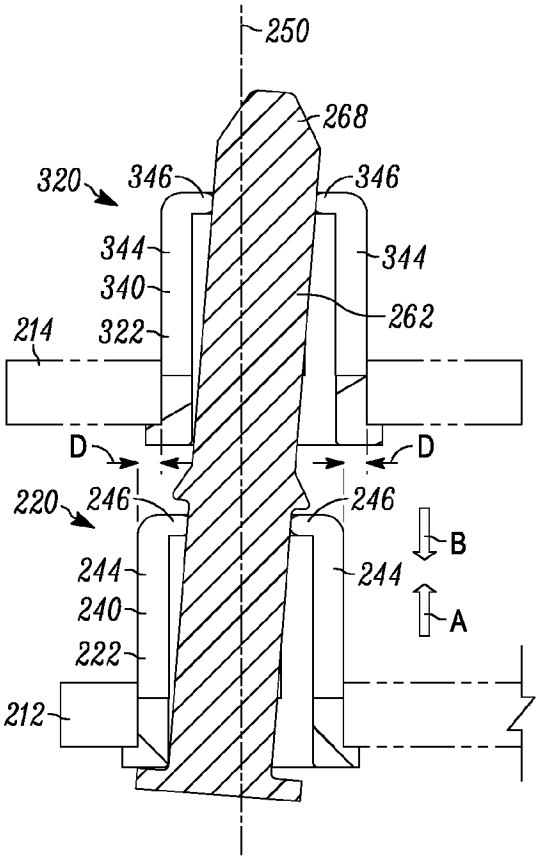
FIGS. 6A-6C depict the function of the apparatus of FIGS. 4A-5.
Figure 6B:
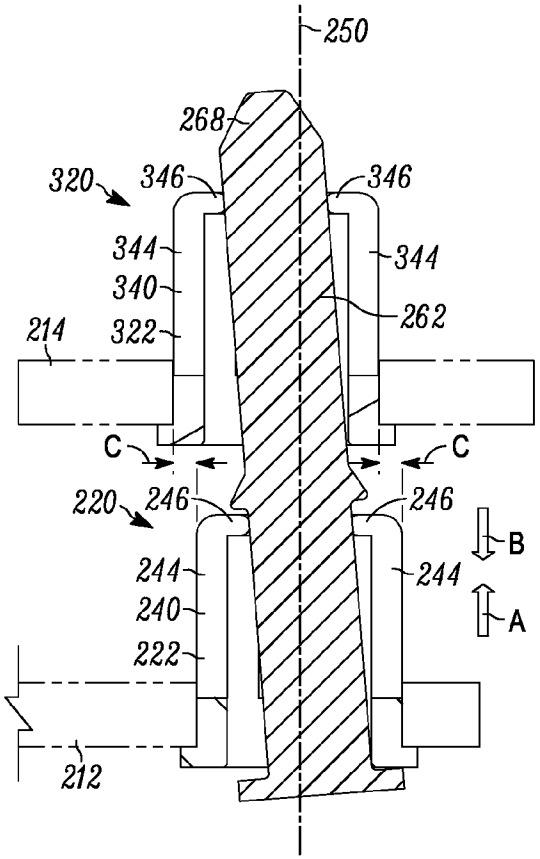
Figure 6A:
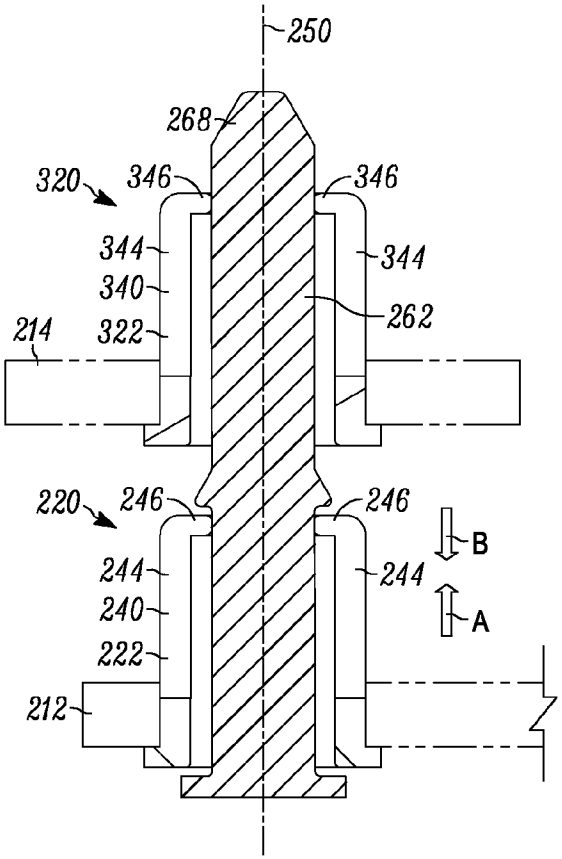

The apparatus 200 can establish an electrical connection between the components 212, 214 even where there may be a misalignment or an alignment mismatch between the components. This is shown in FIGS. 6A-6C. In FIG. 6A, the components 212, 214 are in alignment and, therefore, the first and second connectors 220, 320 are aligned along the axis 250. To establish the connection, the components 212, 214 are brought together such that the first and second connectors 220, 320 engage each other axially. This is indicated generally by the arrows labeled "A" and "B" in FIGS. 6A-6C. To establish the connection, the component 212 can move into engagement with stationary component 214 (arrow A); the component 214 can be brought into engagement with stationary component 212 (arrow B); or the components 212, 214 can be brought into engagement with each other simultaneously (arrows A and B).

When the components 212, 214 are brought together, the head portion 262 enters the second connector 320 and engages the elastic element 340. The beams 344 of the elastic element 340 deflect when receiving the head portion 262 and, due to their inherent resilience, apply a radially compressive force on the head portion via the retainer portions 346. In this manner, the second connector 320 acts as a "compliant socket" connector in which the spring arms 340 conform to the shape and/or orientation of the contact element 260. The compressive forces applied to the contact member 260 by the elastic elements 240, 340 establish and maintain electrical continuity between the components 212, 214. More specifically, the conductive path extends from the first component 212, through the housing 222 and contact element 260, and through the housing 322 to the second component 214.

Referring to FIG. 6A, the components 212, 214 are aligned with each other, so the engaging movement between the components 212, 214 occurs essentially along the axis 250. In FIGS. 6B and 6C, there is a misalignment between the components 212, 214 that is indicated generally by the arrows labeled "C" and "D," respectively. When these mismatches occur, the conical tip 268 of the contact element 260 can act as a guide that causes the contact element to shift relative to the axis 250 as shown. The elastic element 240 permits this shifting while maintaining a strong and reliable electrical connection with the contact element 260. The tip 268 guides the head portion 262 of the contact element 260 into the second connector 320. Due to the compliant socket configuration of the second connector 320, the elastic element 340, i.e., spring arms, receive and comply with the shape and orientation of the head portion 262. The elastic element 340 applies a radially compressive force onto the head portion 262 and thereby establishes the electrical connection between the components 212, 214 despite the alignment mismatch between the components.

The apparatus 200 employs a floating pin/compliant socket design of the first and second connectors 220, 320 that can reliably establish an electrical connection between the components 212, 214 even where there is an alignment mismatch between the components. The amount of alignment mismatch that the apparatus 200 can accommodate can be controlled through the configuration of the first and second connectors 220, 320. For example, increasing/decreasing the length of the contact element 260 would produce a corresponding increase/decrease in the radial range of the tip 268 of the head portion 262, which would increase/decrease the amount of mismatch that the apparatus 200 can accommodate. As another example, the length of the elastic elements 240, 340, and the shape of the beams 244, 344 and retainer portions 246, 346 can be adjusted to control the degree to which the contact element 260 can move relative to the housing 222 and the degree of axial offset or transverse orientation of the contact element that the second connector 320 can accept.

Additionally, the ability for the connectors 220, 320 to accommodate an alignment mismatch can help facilitate multiple simultaneous electrical connections because the multiple connectors can also adapt to and correct for alignment mismatches between the multiple connectors pairs, such as by arranging the connectors in a predetermined spaced apart manner (e.g., according to a prescribed connector pattern and spacing) for each of the respective components 212 and 214. Furthermore, the floating pin design of the apparatus 200 can establish the electrical connections of the components 212, 214 simultaneously with the physical installation of the component(s) in the system.

The apparatus 200 establishes an electrical connection between the components that is effective, reliable, and capable of handling high power loads. For example, the apparatus 200 can be used to establish bus bar or circuit board power connections capable of withstanding 100 Amps or more. The floating pin design of the connectors 220, 320 allows for these reliable high power connections while allowing for misalignment between the components. In one example, the first and second connectors 220, 320 can be capable of establishing these high power connections while accommodating radial misalignments in excess of 0.040 inches or more. Configurations capable of accommodating radial alignments of greater or lesser magnitudes can also be configured.

To help facilitate this high power connection, the mating surfaces of the first and second connectors 220, 320, i.e., the mating surfaces between the contact element 260 and the respective elastic elements 240, 340, can have certain attributes that promote a strong and reliable electrical connection. For example, the mating surfaces of the first and second connectors 220, 320 can have a roughness that is eight (8) micro-inches or less. Additionally or alternatively, the mating surfaces of the first and second connectors 220, 320 can be plated with an initial layer of nickel that is at least 50 micro-inches thick and a layer of hard gold, on top of the nickel, that is at least 30 micro-inches thick. For the example embodiment illustrated in FIGS. 3A-6C, is would be the retainer portions 346 and the contact element 260 that could receive these surface treatments.

Figure 7:
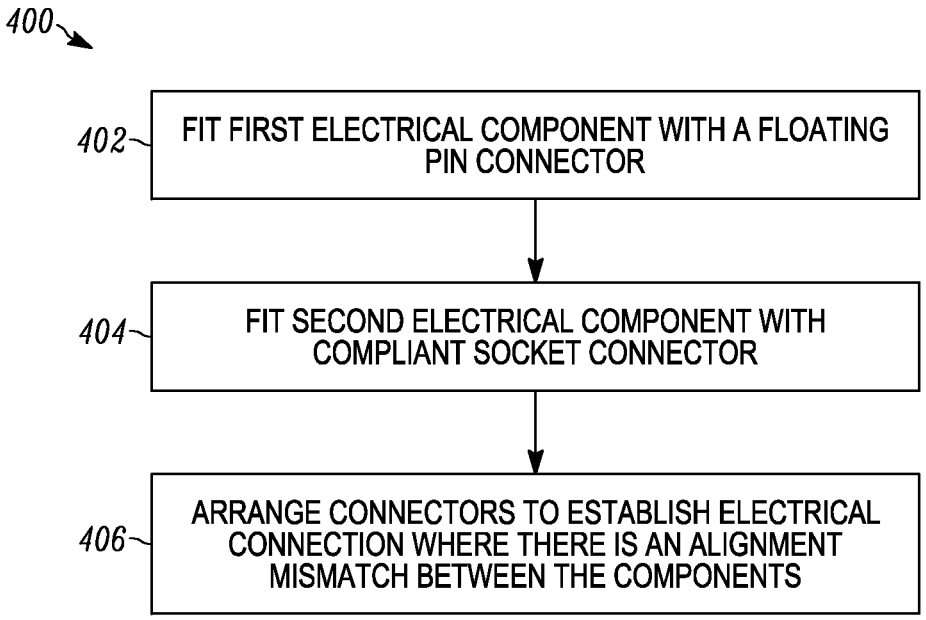
FIG. 7 depicts an example of a method for establishing an electrical connection.

Applying the apparatus 10, 200 described above, a method for establishing an electrical connection between components where there can be a misalignment or an alignment mismatch is illustrated in FIG. 7. Although the operations of the method are illustrated and described as occurring in a particular sequence, it should be understood that the operations can be performed in any order or simultaneously.

Referring to FIG. 7, at 402, the method 400 includes fitting a first electrical component with a floating pin connector. The floating pin connector includes a housing connectable with the first component, and a contact element supported in the housing, such as disclosed with respect to FIGS. 1-6. The contact element is supported in the housing by an elastic element that permits the contact element to move or "float" relative to the housing (see, e.g., housing and contact element in FIG. 3). At 404, the method also includes fitting a second electrical component with a compliant socket connector for receiving the floating pin connector. The compliant socket connector includes a second housing connectable with the second component, and an elastic element into which the contact element can be inserted. At 406, the method further comprises arranging the floating pin connector and compliant socket connector so that an electrical connection can be established where there is an alignment mismatch between the first and second components.

What have been described above are examples. It is, of course, not possible to describe every conceivable combination of structures, components, or methods, but one of ordinary skill in the art will recognize that many further combinations and permutations are possible. Accordingly, the invention is intended to embrace all such alterations, modifications, and variations that fall within the scope of this application, including the appended claims.

Where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, the term "including" means including but not limited to. The term "based on" means based at least in part on.

What is claimed is:

1. An apparatus comprising:

a first electrical connector comprising:

a first housing, a contact element extending along an axis and having a first portion, a second portion, and a stop portion separating the first and second portions, the stop portion extending radially beyond the first and second portions, the first portion comprising a terminal end portion having an annular groove for receiving a fastening element, the annular groove spaced axially apart from the stop portion and positioned outside of the first housing, the stop portion being positioned outside the first housing, and a first elastic element for supporting the first portion in the first housing, the first elastic element being deflectable to permit the contact element to move relative to the first housing; and a second electrical connector comprising:

a second housing, and a second elastic element that is deflectable to receive and retain the second portion of the contact element that protrudes from the first housing.

2. The apparatus of claim 1, wherein deflection of the first elastic element permits the contact element to shift in at least one of radial and transverse directions relative to the housing.

3. The apparatus of claim 1, wherein the second elastic element is deflectable to accept insertion of the second portion of the contact element along a path that is at least one of radially offset from and transverse to a central axis of the second housing.

4. The apparatus of claim 1, wherein the contact element provides electrical continuity between the first and second housings.

5. The apparatus of claim 1, wherein the first elastic element is constructed of an electrically conductive material that provides electrical continuity between the first housing and the contact element, the first elastic element to maintain electrical continuity between the first housing and the contact element regardless of any radially offset or transverse relation between the first portion and the first housing.

6. The apparatus of claim 1, wherein the second elastic element is constructed of an electrically conductive material that provides electrical continuity between the second housing and the contact element, wherein the second elastic element maintains electrical continuity between the second housing and the contact element regardless of any radially offset or transverse relation between the second portion and the second housing.

7. The apparatus of claim 1, wherein the first and second elastic elements are separate elements supported in the first and second housings, respectively, the first and second elastic elements having hyperboloid configurations adapted to deflect outward when receiving the contact element, the members elements being configured to apply a radially compressive force onto the contact element due to their inherent resilient characteristics.

8. The apparatus of claim 7, wherein the first and second housings comprise cylindrical side walls that support the first and second elastic elements, the first and second elastic elements exerting a radially outward force on the side walls that helps maintain the first and second elastic elements supported in the first and second housings.

9. The apparatus of claim 1, wherein the first and second elastic elements comprise integral portions of the first and second housings, respectively, wherein the first and second elastic elements comprise a plurality of elastic arms defined by a plurality of axially extending slots in the first and second housings, the elastic arms being configured to apply a radially compressive force onto the contact element due to their inherent resilient characteristics.

10. The apparatus of claim 1, wherein the contact element comprises an electrically conductive pin, the first portion being fastened to the first housing in a manner so as to be movable relative to the first housing, the first elastic element at least partially encircling the first portion of the pin and exerting a radially inward force on the pin that urges the pin into coaxial alignment with the first housing, the pin being fastened to the first housing by at least one of a press-fit, a swage-fit, a fastener, and a clip.

11. The apparatus of claim 1, wherein the first and second housings are adapted for being press-fitted into an aperture in a receiving structure, the receiving structure comprising at least one of a bus bar and a printed circuit board.

12. The apparatus of claim 1, wherein the first housing comprises a cylindrical side wall and an end wall that includes an opening through which the contact element extends, the edge of the opening limiting movement of the pin relative to the housing.

13. An apparatus comprising:

a floating pin electrical connector comprising a housing having a central axis, an elongated contact element, and an elastic element biased between the contact element and the housing to connect the contact element to the housing, the elastic element permitting the contact element to move relative to the central axis while maintaining the biased connection between the housing and the contact element, the contact element including a first portion, a second portion, and a stop portion separating the first and second portions, the stop portion extending radially beyond the first and second portions and being positioned outside the elastic element wherein the elastic element comprises an integral portion of the housing, the elastic element comprising a plurality of elastic arms defined by a plurality of axially extending slots in the housing, the elastic arms being configured to apply a radially compressive force onto the elongated contact element due to their inherent resilient characteristics, each of the plurality of elastic arms comprising a respective beam portion and a respective retainer portion, the beam portion extending longitudinally and being parallel to the central axis, the retainer portion configured to contact the elongated contact element.

14. The apparatus of claim 13, wherein the elastic element provides electrical continuity between the contact element and the housing and maintains the electrical continuity throughout the range of relative movement of the contact element relative to the housing, the elastic element permitting the contact element to move radially relative to the central axis and transverse to the central axis.

15. The apparatus of claim 13, wherein the elastic element has a hyperboloid configuration encircling a portion of the contact element, the hyperboloid elastic element adapted to deflect resiliently outward when receiving the contact element and apply a corresponding radial compressive force on the contact element.

16. The apparatus of claim 13, further comprising a compliant socket electrical connector for receiving a portion of the contact element that protrudes from the floating pin electrical connector, the compliant socket electrical connector comprising a second housing and a second elastic element that is deflectable to accept insertion of the portion of the contact element along a path that is at least one of radially offset from and transverse to a central axis of the second housing.

17. A method comprising:

fitting a first electrical component extending along a first axis with a floating pin connector;

fitting a second electrical component extending along a second axis with a compliant socket connector; and arranging the floating pin connector and compliant socket connector so that an electrical connection can be established where there is an alignment mismatch between the first and second components such that the first axis and the second axis parallel to one another;

inserting a contact element into the floating pin connector and into the complaint socket connector to establish an electrical connection between the floating pin connector and the compliant sock connector, the contact element having a first portion, a second portion, and a stop portion separating the first and second portions, the stop portion extending radially beyond the first and second portions; and providing a fastening element in an annular groove at a terminal end portion of the first portion, the annular groove spaced axially apart from the stop portion and position outside of a first housing wherein fitting the first electrical component comprises providing the first housing connectable with the first electrical component and the contact element supported in the first housing by a first elastic element that permits the contact element to move relative to the first housing wherein the first elastic element comprises an integral portion of the first housing, the first elastic element comprising a plurality of elastic arms defined by a plurality of axially extending slots in the first housing, the elastic arms being configured to apply a radially compressive force onto the contact element due to their inherent resilient characteristics, each of the plurality of elastic arms comprising a respective beam portion and a respective retainer portion, the beam portion extending longitudinally and being parallel to the first axis, the retainer portion configured to contact the contact element.

18. The method of claim 17, wherein the fitting a second electrical component comprise providing a second housing connectable with the second component and a second elastic element into which the contact element can be inserted, the second elastic element being deflectable so as to accommodate receiving the contact element where there is an alignment mismatch between the first and second components.

19. The apparatus of claim 1, wherein the stop portion of the contact element is positioned between the first elastic element and the second elastic element.

20. The apparatus of claim 1, wherein the fastening element comprises an end stop extending radially from the terminal end of the first portion of the contact element, wherein the end stop and the stop portion form respective interference fits with openings at opposed ends of the first housing to limit axial movement of the contact element.

21. The apparatus of claim 1, wherein the first housing extends along a first axis and the second housing extends along a second axis parallel to the first axis, the axis of the contact element extending transverse to at least one of the first and second axes.

22. The apparatus of claim 13, wherein the fastening element comprises an end stop extending radially from the terminal end of the first portion of the contact element, the stop portion forming an interference fit with a first opening in the housing and the end stop forming an interference fit with a second opening in the housing to limit axial movement of the contact element relative to the housing, wherein the elastic element engages the first portion of the contact element, and wherein the stop portion and the second portion of the contact element are positioned outside the housing.

23. The method of claim 17, wherein inserting the contact element comprising positioning the stop portion of the contact element between the floating pin connector and the compliant socket connector.

24. The method of claim 23, further comprising:

providing a retaining ring on the contact element spaced from the stop portion on an opposite side of the floating pin connector from the stop portion;

securing the stop portion in a first opening of the floating pin connector; and securing the retaining ring in a second opening of the floating pin connector to prevent removal of the contact element from the floating pin connector.

25. The apparatus of claim 13, wherein the retainer portion extends radially inward from an end of the beam portion.

26. The method of claim 17, wherein fitting the first electrical component comprises fitting the first electrical component wherein the retainer portion extends radially inward from an end of the beam portion.

* * * * *